US005405129A

United States Patent [19]

Mihara et al.

[11] Patent Number: 5,405,129

[45] Date of Patent: Apr. 11, 1995

[54] DETECTING DEVICE FOR DETECTING PRESENCE OF ITEMS IN A MULTIPLE SUPPLY ARRANGEMENT

[75] Inventors: Takashi Mihara; Seiji Kikuchi; Masaki Tsuchiya; Junichiro Higuma; Hiromi Okada, all of Osaka, Japan

[73] Assignee: Mita Industrial Co., Ltd., Osaka, Japan

[21] Appl. No.: 147,223

[22] Filed: Nov. 3, 1993

[30] Foreign Application Priority Data

Nov. 17, 1992 [JP] Japan ..... 4-307262

[51] Int. Cl.[6] ..... B65H 7/08; B65H 3/44

[52] U.S. Cl. ..... 271/111; 271/9; 271/259

[58] Field of Search ..... 271/9, 110, 111, 258–263, 271/265

[56] References Cited

U.S. PATENT DOCUMENTS 5,290,021 3/1994 Murooka et al. ..... 271/111 X
5,318,286 6/1994 Makiura et al. ..... 271/259 X

FOREIGN PATENT DOCUMENTS 531816 3/1993 European Pat. Off. ..... 271/111
211250 9/1987 Japan ..... 271/9
286953 7/1990 Japan .

*Primary Examiner*—Robert P. Olszewski
*Assistant Examiner*—Boris Milef
*Attorney, Agent, or Firm*—Jordan and Hamburg

[57] ABSTRACT

A detecting device is adapted for detecting the presence of an item and includes a shaft rotatably supported on a frame, a first contacting member attached to the shaft and operable to come into contact with an item; a second contacting member attached to the shaft and operable to come into contact with an item, the second contacting member being spaced away from the first contacting member in an axial direction of the shaft by a specified distance, a pivotal member, a detector for detecting whether the pivotal member is at a specified detecting position, and a transmission device for transmitting a rotation of either the first or second contacting member to the pivotal member to rotate the pivotal member to the specified detecting position.

10 Claims, 12 Drawing Sheets

DETECTING DEVICE FOR DETECTING PRESENCE OF ITEMS IN A MULTIPLE SUPPLY ARRANGEMENT

BACKGROUND OF THE INVENTION

The present invention relates to a detecting device for detecting the presence of an item, such as sheets, envelopes, transported side by side.

There have been known image forming apparatuses such as copying machines and printers in which uppermost ones of two stacks of sheets contained side by side in a cassette are fed and transported simultaneously side by side to a photosensitive member and two toner images formed side by side on the surface of the photosensitive member are transferred to these two sheets.

In the above image forming apparatuses, when one of the sheet stacks in the cassette is used up or one of the sheets being transported side by side causes a jam along a transport path to the photosensitive member, the following problem occurs if the other sheet continues to be transported and the toner images are formed side by side. The toner forming the toner image corresponding to the side on which no sheet is being transported attaches to a transfer device and a transport path downstream from the transfer device, thereby staining the transport path and the transfer device and consequently a subsequently fed sheet. Further, when a sheet on either path causes a jam along a transport path extending from the photosensitive member to a discharge tray, it is necessary to detect the jam and remove the jammed sheet immediately.

Because of the above mentioned problems, it has been required to detect the absence of a sheet in one of the stacks in the cassette or an abnormal transport state of a sheet and to stop the feeding of the sheet and notify an operator of such an undesirable event.

In response to this requirement, sheet detectors have been provided individually in respective stacks of the cassette or along respective transport paths for the sheets. However, this arrangement necessitates as many sheet detectors as the transport paths, thereby complicating the construction of the image forming apparatus, and takes time and labor in wiring or the like.

Paying a special attention to that the feeding of sheets is stopped and the notification to the operator is made when the abnormality occurs along at least one of the transport paths along which sheets are transported, the following detecting device having a simplified construction is disclosed in Japanese Unexamined Utility Model Publication No. 2-86953. Specifically, this detecting device includes a plurality of contacting members, a plurality of pivotal members, and a photosensor. The contacting members are mounted on the same shaft and rotate according to the presence or absence of the sheet along the transport paths. The pivotal members as many as the contacting members are arranged side by side so as to move together with the corresponding contacting members. The photosensor includes a pair of a light emitter and a light detector which are arranged in such a manner that the pivotal members are held therebetween. With this detecting device, it can be detected using these contacting members, pivotal members, and photosensor whether the abnormality has occurred along at least one of the transport paths.

However, with the construction disclosed in the above reference, the number of pivotal members increases when the number of transport paths increases.

Accordingly, it is necessary to space the light emitter and the light detector by a longer distance. This leads to the large size photosensor and therefore an increase in the production cost. Further, when the distance between the light emitter and the light detector becomes longer, these elements become more subject to the influence of the external light, thereby reducing the reliability of the photosensor.

SUMMARY OF THE INVENTION

In view of the problems residing in the prior art, it is an object of the invention to provide a detecting device for detecting the presence of an item which is simple in construction and capable of detecting reliably the presence or absence of items at juxtaposed positions.

Accordingly, the present invention is directed to a detecting device for detecting the presence of an item comprising: a shaft rotatably supported on a frame; a first contacting member attached to the rotatable shaft and operable to come into contact with an item; a second contacting member attached to the rotatable shaft and operable to come into contact with an item, the second contacting member being spaced away from the first contacting member in an axial direction of the rotatable shaft by a specified distance; a pivotal member; detector means for detecting whether the pivotal member is at a specified detecting position; and transmission means for transmitting a rotation of either the first or second contacting member to the pivotal member to rotate the pivotal member to the specified detecting position.

Also, the first and second contacting members are attached to the shaft rotatably independently from each other and each have a tendency of rotating in a specified direction by the weight thereof in their respective free states.

Further, the first and second contacting members are attached to the shaft rotatably independently from each other and each are stayed at a specified position by the weight thereof in their respective free states and are movable in a specified direction by the item.

Further, it may be appropriate that the shaft is constructed by a first cylinder fixedly attached with the first contacting member; second hollow cylinder concentrically provided around the first cylinder and fixedly attached with the second contacting member; and the transmission means is constructed by a first pin provided on one end surface of the first cylinder and extending in an axial direction of the first cylinder; a second pin provided on one end surface of the second hollow cylinder and extending in the axial direction of the second hollow cylinder; slit means provided in the pivotal member, the slit means having a first arcuate slit formed along a rotational locus of the first pin and engageable with the first pin, a second arcuate slit formed along a rotational locus of the second pin and engageable with the second pin; whereby when either the first or second contacting member rotates beyond a specified rotational angle in the specified direction, either the first or second pin transmits the specified direction rotation of the contacting member to the pivotal member.

Further, it may be appropriate that the shaft is constructed by a first support portion for supporting the first contacting member; a second support portion for supporting the second contacting member; a shaft member fixedly attached with the pivotal member and being rotatable independently of the first and second contacting members; and the transmission means is constructed by a first radial rod fixedly attached to the shaft member and extending outward in a radial direction of the shaft member; a second radial rod fixedly attached to the shaft member and extending outward in a radial direction of the shaft member; a first axial rod fixedly attached to the first contacting member and extending in an axial direction of the shaft member and being engageable with the first radial rod; a second axial rod fixedly attached to the second contacting member and extending in an axial direction of the shaft member and being engageable with the second radial rod; whereby when either the first or second contacting member rotates beyond a specified rotational angle in the specified direction, either the first or second axial rod engages with the first or second radial rod to transmit the specified direction rotation of the contacting member to the pivotal member.

Furthermore, it may be appropriate that the shaft is constructed by a first support portion for supporting the first contacting member; a second support portion for supporting the second contacting member; a shaft member fixedly attached with the pivotal member and being rotatable independently of the first and second contacting members; and the transmission means is constructed by a first arm member fixedly attached to the shaft member and engageable with the first contacting member; a second arm member fixedly attached to the shaft member and engageable with the second contacting member; whereby when either the first or second contacting member rotates beyond a specified rotational angle in the specified direction, either the first or second contacting member engages with the first or second arm member to transmit the specified direction rotation of the contacting member to the pivotal member.

With thus constructed detecting device, when either the first or second contacting member rotates beyond a specified position in the specified direction, the pivotal member is rotated in the specified direction and then detected by the detector means. This enables the movement of one of a plurality of contacting members to be detected by a single detector means, which can accordingly simplify the construction of the detecting device, and further reduce the time and labor taken for wiring.

Also, the pivotal member rotates according to the rotation of one contacting member while the other contacting members are stayed. Accordingly, this arrangement assures the other contacting members will not hinder the rotation of the pivotal member in the specified direction. Further, even if an increased number of contacting members are provided, the pivotal member can be easily rotated by only one contacting member irrespective of the others of the increased number of contacting members.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
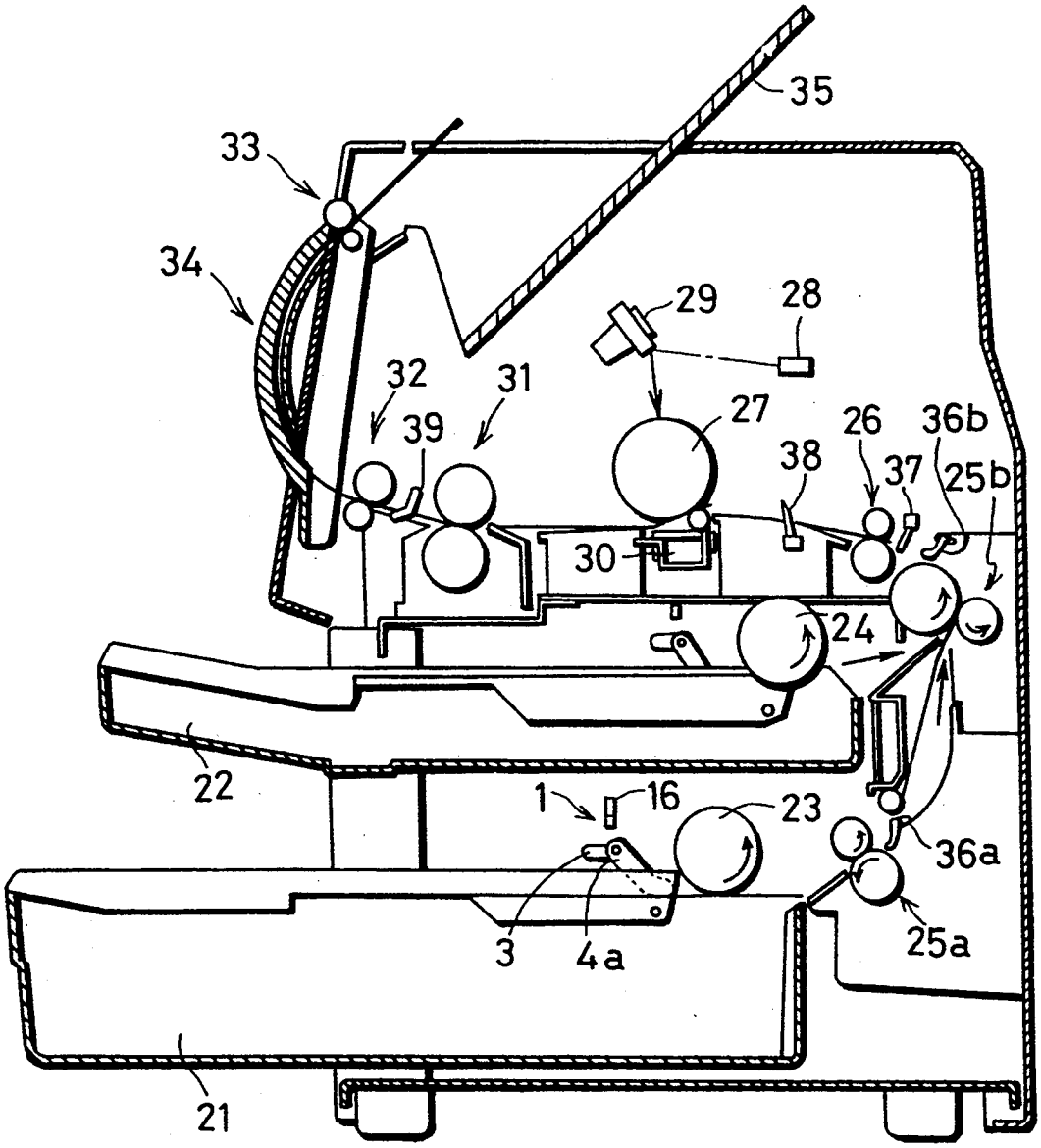
FIG. 1 is a schematic diagram showing a construction of an image forming apparatus incorporating a detecting device for detecting the presence of an item according to the invention.

FIG. 1 is a schematic construction diagram showing an exemplary image forming apparatus incorporating a detecting device for detecting the presence of an item according to the invention.

This image forming apparatus includes cassettes 21, 22, feed rollers 23, 24, pairs of separating rollers 25*a*, 25*b*, a pair of registration rollers 26, a photosensitive member 27 and an unillustrated imaging assembly arranged around the member 27, a light emitting unit 28 including a laser, a polygonal mirror 29, a transfer device 30, a fixing device 31 including a fixing roller, pairs of discharge rollers 32, 33, a discharge guide 34, a discharge tray 35, etc. It is noted that the cassette 21 contains two stacks of sheets smaller than normal sized sheets so that a plurality of sheets can be fed simultaneously side by side, whereas the cassette 22 contains normal sized sheets.

Figure 2:
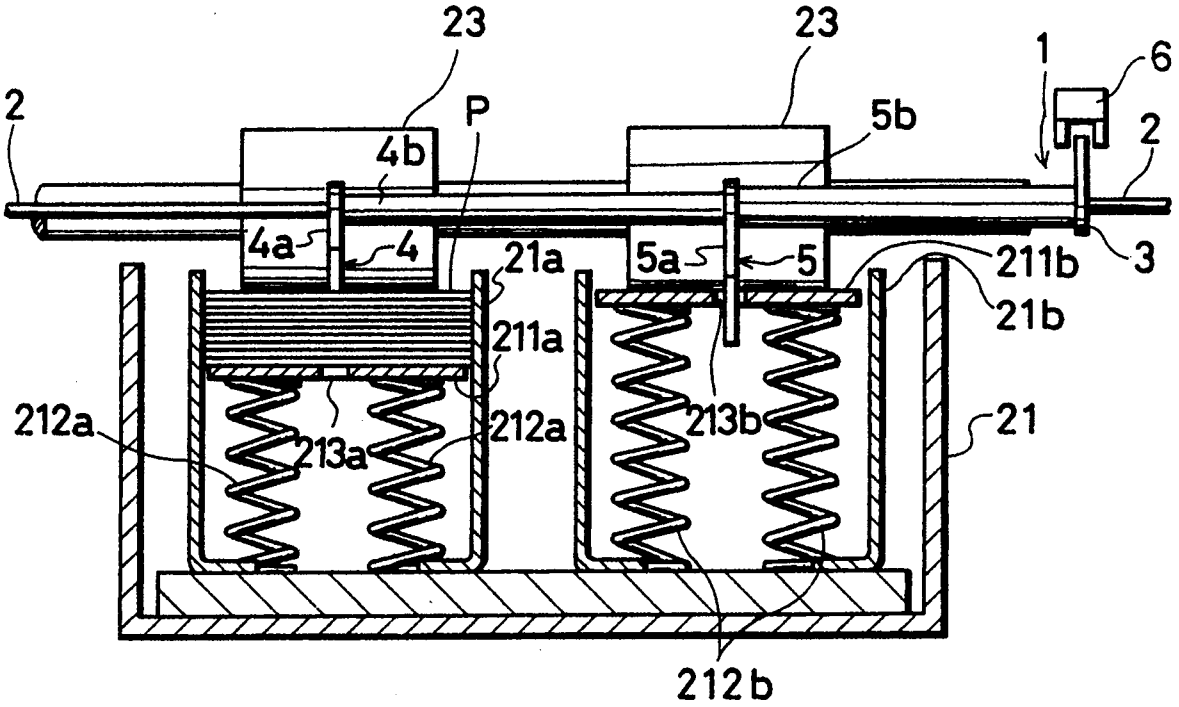
FIG. 2 is a sectional diagram showing the detecting device as used to detect the presence of sheets.
Figure 3B:
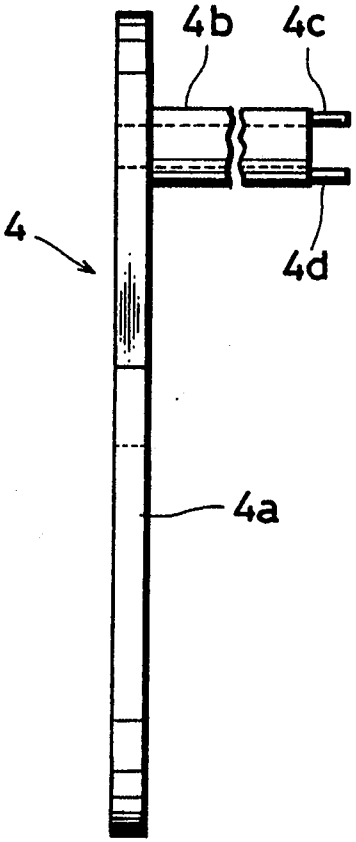
FIGS. 3A and 3B are a side view and a front view showing one contacting member of the detecting device respectively.
Figure 3A:
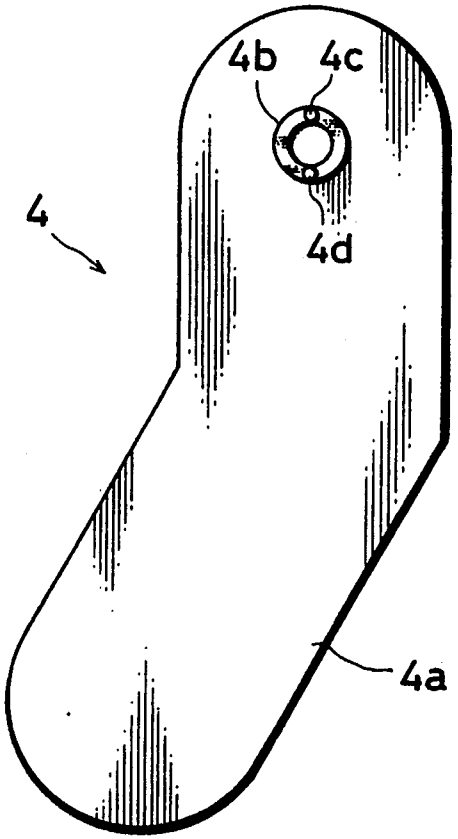

As shown in FIG. 2, two sheet aligning units 21*a*, 21*b* are arranged side by side in the cassette 21. The sheet aligning units 21*a*, 21*b* include sheet placing plates 211*a*, 211*b* respectively on which sheets P are placed. These plates 211*a*, 211*b* are biased upward by helical springs 212*a*, 212*b* provided between them and a bottom plate of the cassette 21, so that the uppermost ones of sheets P are in contact with the feed roller 23 at a suitable pressure.

The image forming apparatus further includes a sheet detecting device 1, multifeed sensors 36*a*, 36*b* for detecting a multiple feeding of sheets, a registration sensor 37, a timing sensor 38, a discharge sensor 39 for detecting the discharge of sheets, etc. The sheet detecting device 1 detects the presence of sheets in the sheet aligning units 21*a*, 21*b*. The registration sensor 37 is used to measure a timing at which the registration rollers 26 are driven. The timing sensor 38 is used to measure a timing at which the light emitter 28 or the like starts emitting the light.

Sheets in the cassette 21 are fed side by side along two transport paths to the separating roller 25*a* by the feed roller 23, and are further transported by the separating rollers 25 one after another along the respective transport paths after being separating thereby. These sheets reach the registration rollers 26 after passing through the separating rollers 25*b* which are in an idly rotatable state at this stage. The driving of the registration rollers 26 is controlled in accordance with a signal from the registration sensor 37.

When the sheets are further transported by the registration rollers 26, the timing sensor 38 outputs a sensor signal. In accordance with this sensor signal, the photosensitive member 27 is rotated, and the light emitting unit 28 modulates optically an image signal input from an external data storage or the like connected with the image forming apparatus and emits the modulated beam (laser beam). The laser beam from the light emitting unit 28 is introduced through the polygonal mirror 29 to the photosensitive member 27, thereby exposing the same. By the aforementioned imaging assembly, two latent images are formed side by side on the surface of the photosensitive member 27 in an axial direction of the member 27 and are developed into toner images. After being transferred to the respective sheets by the transfer device 30, the toner images are fixed onto the sheets by the fixing device 31. Consequently, the sheets are discharged onto the discharge tray 35 through the pairs of discharge rollers 32, 33 and the discharge guide 34.

There will be described the sheet detecting device 1 next with reference to FIGS. 2 to 10.

The sheet detecting device 1 includes a shaft 2, a pivotal member 3, contacting members 4, 5, and a photosensor having a pair of a light emitter and a light detector. The shaft 2 is disposed in a suitable position above the cassette 21 in parallel with an axial direction of the feed roller 23 (see FIG. 2). A base portion of the pivotal member 3 is rotatably mounted on the shaft 2 and base portions of the contacting members 4, 5 are fixedly mounted on the shaft 2.

The shaft 2 is supported on an unillustrated frame of the image forming apparatus. The contacting members 4, 5 include contacting plates 4*a*, 5*a* and hollow cylinders 4*b*, 5*b* serving as rotatable shafts respectively. One end of each of the hollow cylinders 4*b*, 5*b* is mounted on a base portion of the corresponding contacting plate. The contacting plates 4*a*, 5*a* have a specified length and are bent at a center portion thereof at a specified angle.

Figure 4B:
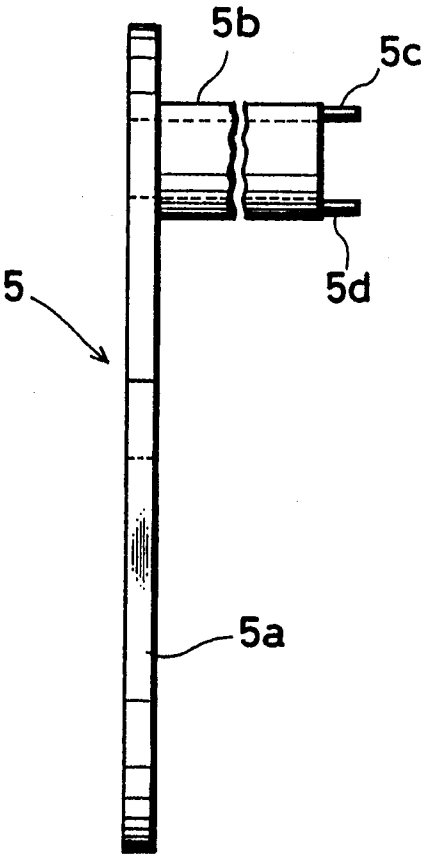
FIGS. 4A and 4B are a side view and a front view showing another contacting member of the detecting device respectively.
Figure 4A:
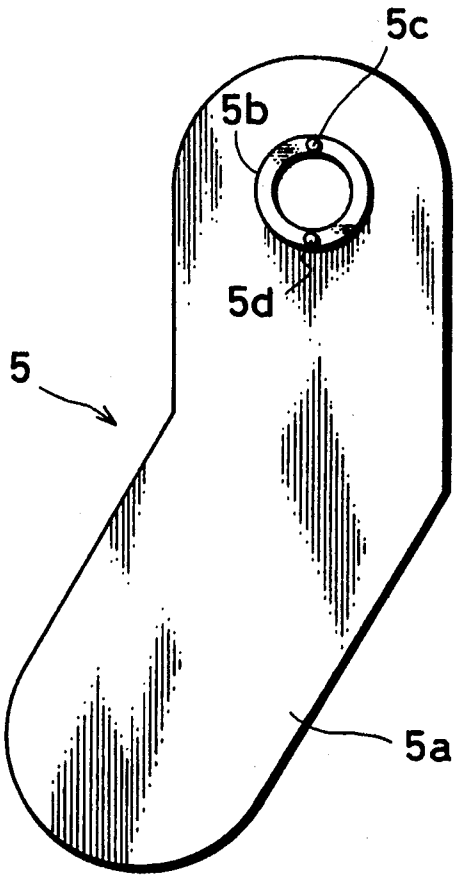

The hollow cylinder 4*b* has a specified length. The shaft 2 is loosely inserted through the hollow cylinder 4*b*. At the other end of the hollow cylinder 4*b* are provided pins 4*c*, 4*d* at opposing positions on the inner circumferential surface of the hollow cylinder 4*b*. The pins 4*c*, 4*d* extend in parallel with an axial direction of the hollow cylinder 4*b*. The hollow cylinder 5*b* has a specified length and a diameter greater than that of the hollow cylinder 4*b*as shown in FIGS. 4A and 4B. The hollow cylinder 4*b* is loosely fitted in the hollow cylinder 5*b*. At the other end of the hollow cylinder 5*b* are provided pins 5*c*, 5*d* at opposing positions on the inner circumferential surface of the hollow cylinder 5*b*. The pins 5*c*, 5*d* extend in parallel with an axial direction of the hollow cylinder 5*b*.

Figure 5B:
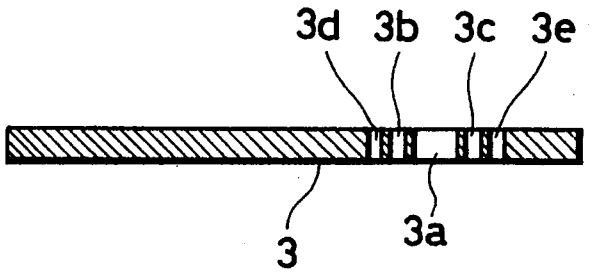
FIG. 5B is a sectional view taken along the line 5B—5B in FIG. 5A.
Figure 5A:
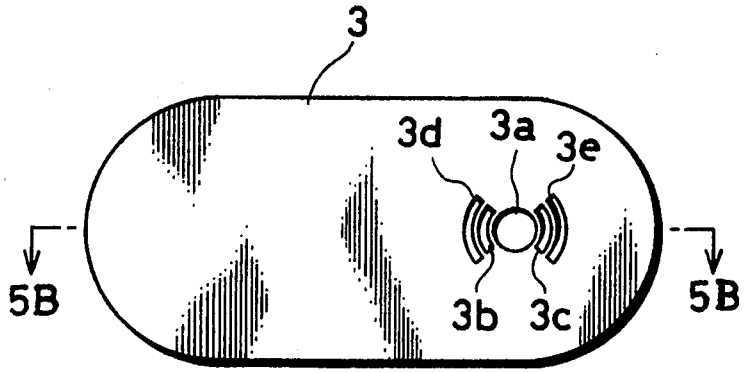
FIG. 5A is a front view showing a pivotal member of the detecting device.

As shown in FIGS. 5A and 5B, the pivotal member 3 is at the base portion thereof formed with a hole 3*a* through which the shaft 2 is loosely inserted. Around the hole 3*a* are formed arcuate slits 3*b*, 3*c* in which the pins 4*c*, 4*d* are fitted loosely. Further outside the slits 3*b*, 3*c* are formed arcuate slits 3*d*, 3*e* in which the pins 5*c*, 5*d* are fitted loosely. The slits 3*b*, 3*c*, 3*d*, 3*e* are formed concentrically. When the shaft 2 is supported rotatably on the frame of the image forming apparatus, the pivotal member may be mounted fixedly on the shaft 2.

Figure 6:
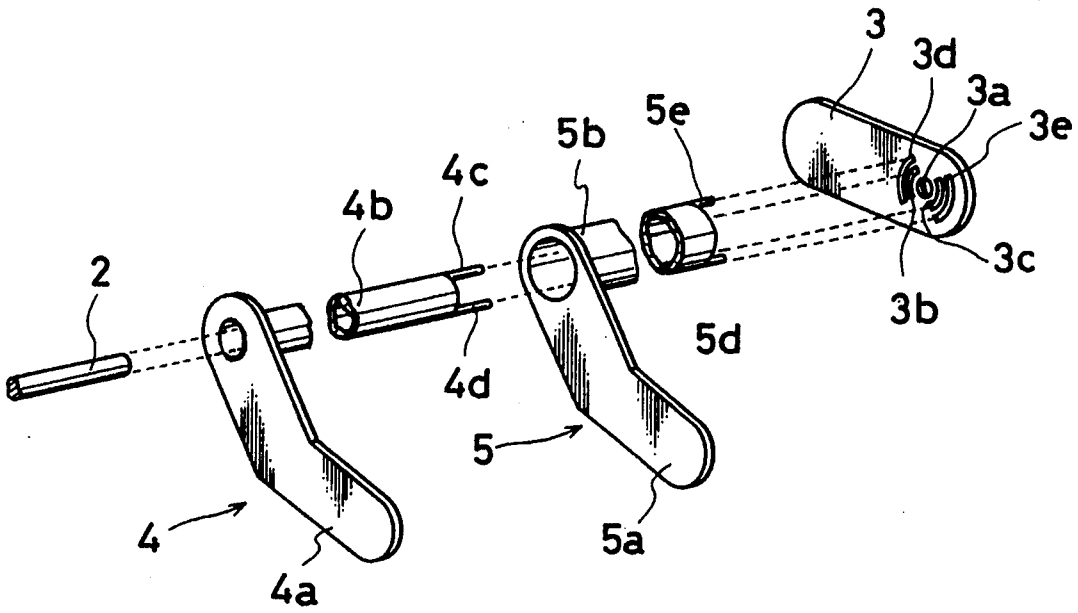
FIG. 6 is an exploded perspective view showing the detecting device.
Figure 7:
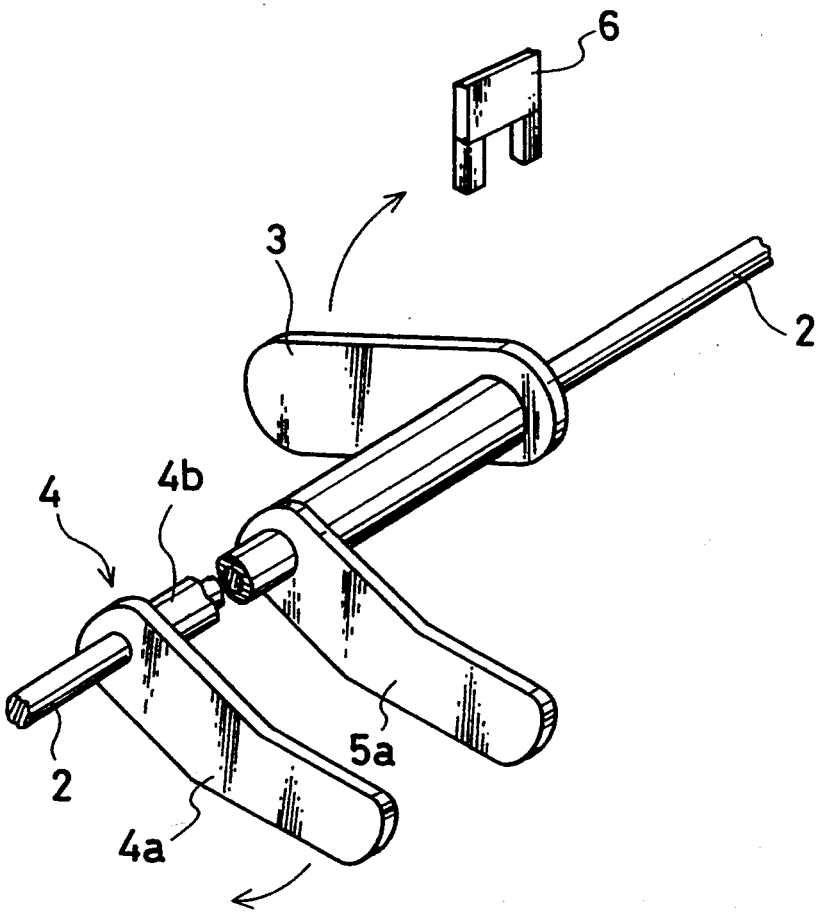
FIG. 7 is a perspective view showing the assembled detecting device.

As shown in FIG. 6, the pins 4*c*, 4*d* of the contacting member 4 are fitted loosely in the slits 3*b*, 3*c* of the pivotal member 3 and the pins 5*c*, 5*d* of the contacting member are fitted loosely in the slits 3*d*, 3*e* of the pivotal member 3 in a state where the hollow cylinder 4*b* of the contacting member 4 is fitted loosely in the hollow cylinder 5*b* of the contacting member 5. In this way, the sheet detecting device 1 is assembled as shown in FIG. 7. The size of the hollow cylinders 4*b*. 5*b* are determined such that leading ends of the contacting plates 4*a*, 5*a*, into an assembled state, come to contact with the uppermost ones of the sheets P placed on the sheet placing plates 211*a*, 211*b* of the sheet aligning units 21*a*, 21*b*. The photosensor 6 is disposed in a position where the leading end of the pivotal member 3 is located between the light emitter and the light detector when the pivotal member 3 rotates clockwise till a position indicated by phantom lines in FIG. 8 to be described later. When one of the contacting members 4, 5, e.g. the contacting member 4, rotates to a suspended position due to the weight thereof from a position where it is in contact with the sheet P, the pins 5*c*, 5*d* of the contacting member 5 rotate relatively counterclockwise along the slits 3*d*, 3*e* of the pivotal member 3. If the slits 3*d*, 3*e* are not long enough, the pins 5*c*, 5*d* come into contact with the other ends of the slits 3*d*, 3*e*, thereby causing the pivotal member 3 to stop rotating further. A center angle of each of the arcuate slits 3*b* to 3*e* is determined so that this will not occur.

Figure 8:
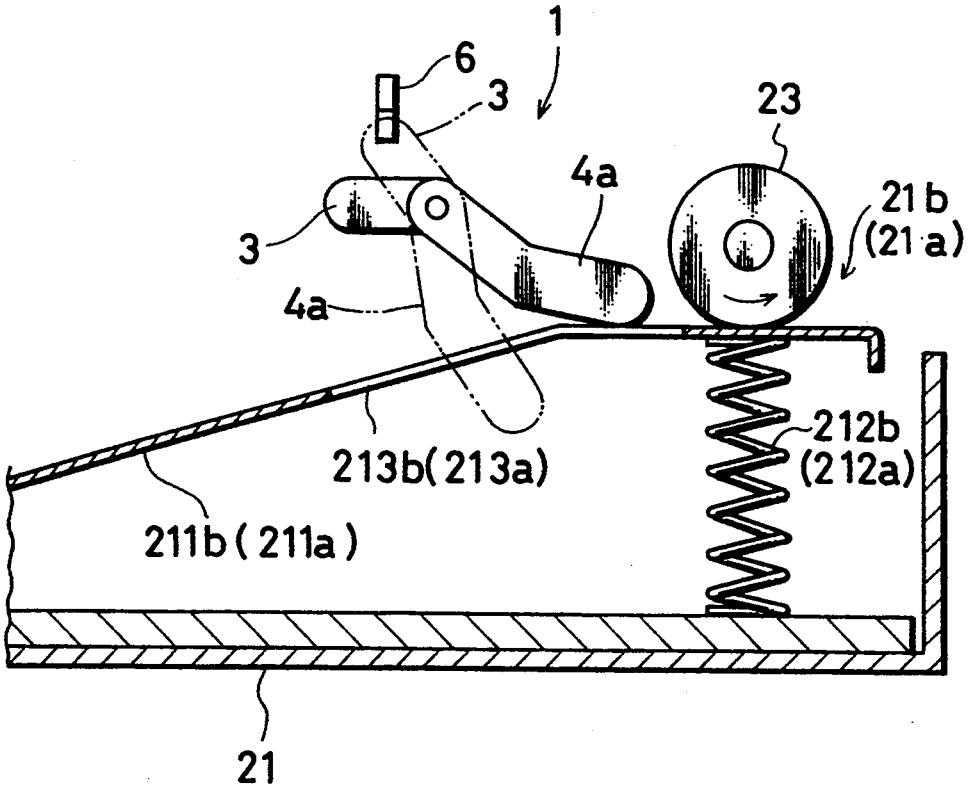
FIG. 8 is a sectional view showing a movement of the detecting device.

The photosensor 6 is disposed at such a position that the pivotal member 3 comes into a space between the light emitter and the light detector thereof when the contacting members 4, 5 are at the respective suspended positions. When the pivotal member 3 is in the space between the light emitter and the light detector, the photosensor 6 is off. The pivotal member 3 is, as shown in FIG. 8, disposed on the left side of the photosensor 6. Accordingly, the pivotal member 3 will not unintentionally rotate clockwise by the weight thereof to interrupt the photosensor 6. Alternatively, the pivotal member 3 may be biased counterclockwise in FIG. 7 by an unillustrated biasing means lest it should rotate clockwise due to the weight thereof.

By assembling the sheet detecting device 1 in this way, the pins 5*c*, 5*d* push the clockwise ends of the slits 3*d*, 3*e* when the sheets are used up only in the sheet aligning unit 21*b* and thereby the contacting member 5 rotates clockwise downward through a groove 213*b* of the unit 21*b* due to the weight thereof. This causes the pivotal member 3 to rotate clockwise by a specified angle (by a position indicated by phantom lines in FIG. 8).

In the above embodiment, the contacting members are usually raised by the stack of sheets, rotating clockwise by the weight thereof as sheets are used, and the pivotal member consequently turns off the photosensor.

However, it may be appropriate to arrange the pivotal member and the contacting members in such a way that the contacting members usually are suspended by the weight and rise or rotate counterclockwise by the sheet to turn off the photosensor. This arrangement enables the sheet detecting device to be used for other functions, such as detection of sheet multifeeding.

Figure 9:
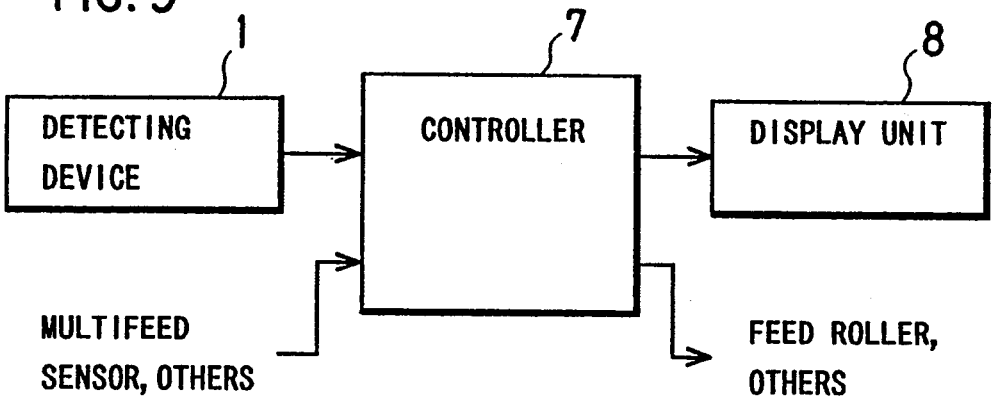
FIG. 9 is a block diagram showing a construction of a control system of the image forming apparatus.

There will be described a control system for controlling an image forming operation in accordance with a signal from the sheet detecting device 1 next with reference to FIG. 9.

A controller 7 drives the feed roller 23, the photosensitive member 27 and the light emitting unit 28 to start the image forming operation upon the receipt of an ON-signal from the photosensor 6. Upon the receipt of an OFF-signal from the photosensor 6, the controller 7 stops the feeding of sheets by the feed roller 23 and the image forming operation or causes a display unit 8 to display a warning "absence of sheet" on the determination that all the sheets have been used up in at least one of the sheet aligning un its 21*a*, 21*b*.

Figure 10A:
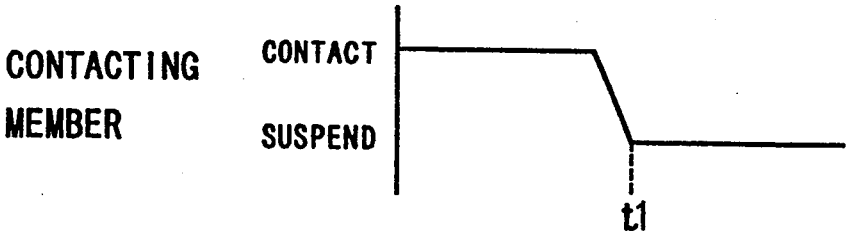
FIG. 10 is a timing chart showing an operation of a photosensor.
Figure 10B:
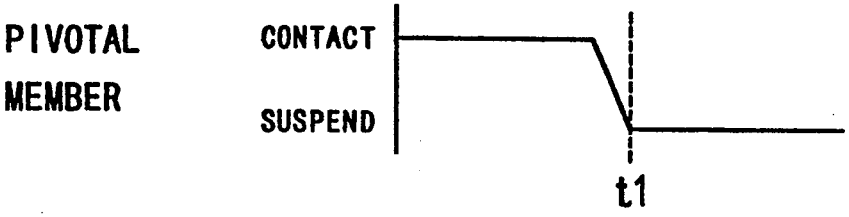
Figure 10C:
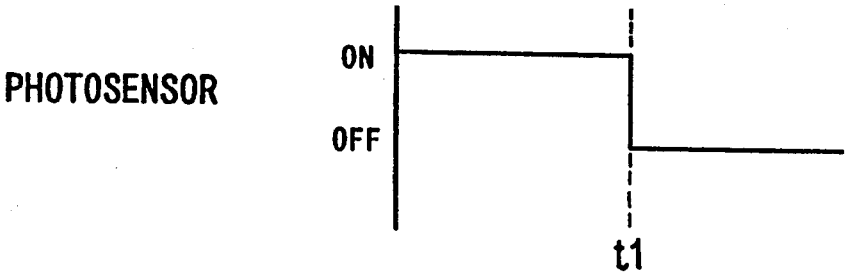

With reference to FIG. 10, when all the sheets P in the sheet aligning unit 21*a* are used up at time t1, the contacting member 4 rotates downward due to the weight thereof and accordingly the pins 4*c*, 4*d* push the clockwise ends of the slits 3*b*, 3*c* of the pivotal member 3, thereby causing the pivotal member 3 to rotate. When the pivotal member 3 reaches the position between the light emitter and the light detector, the photosensor 6 is turned off. Simultaneously, the controller 7 assumes the absence of sheets; stops the feeding of sheets and the image forming operation; and causes the display unit 8 to display the warning "absence of sheet".

Since the absence of sheets in at least one of the two sheet aligning units 21, 21*b* can be detected with the single pivotal member 3, the sheet detecting device 1 is allowed to have a simplified construction and wiring system compared to the case where pivotal members are arranged in correspondence with the respective sheet aligning units 21*a*, 21*b*. Further, when the sheets are used up only, for example, in the aligning unit 21*b* and the contacting member 5 rotates clockwise, the contacting member 4 corresponding to the aligning unit 21*a* rotates counterclockwise relative to the rotation of the pivotal member 3. Accordingly, the contacting member 4 is allowed to be stably in contact with the uppermost one of sheets in the aligning unit 21*a* and does not hinder the rotation of the pivotal member 3.

The pivotal member 3 may be disposed between the contacting members 4 and 5. In this case, the axial dimension of the contacting members 4, 5 is set suitably according to the disposed position of the pivotal member 3. Further, the photosensor 6 may be disposed desirably within a range determined by an angular position of the pivotal member 3 when the contacting members 4, 5 are in contact with the sheets P and when the contacting members 4, 5 stay at the suspended position due to the weight thereof.

Although the cassette 21 is provided with two juxtaposed sheet aligning units in this embodiment, the invention is also applicable even when it is provided with three or more juxtaposed sheet aligning units. In this case, it will be appropriate to dispose contacting members, each including a hollow cylinder and pins similar to those described above, in correspondence with the respective sheet aligning units and to form in the pivotal member concentrically arcuate slits in which the pins of the respective contacting members are fitted.

Figure 11:
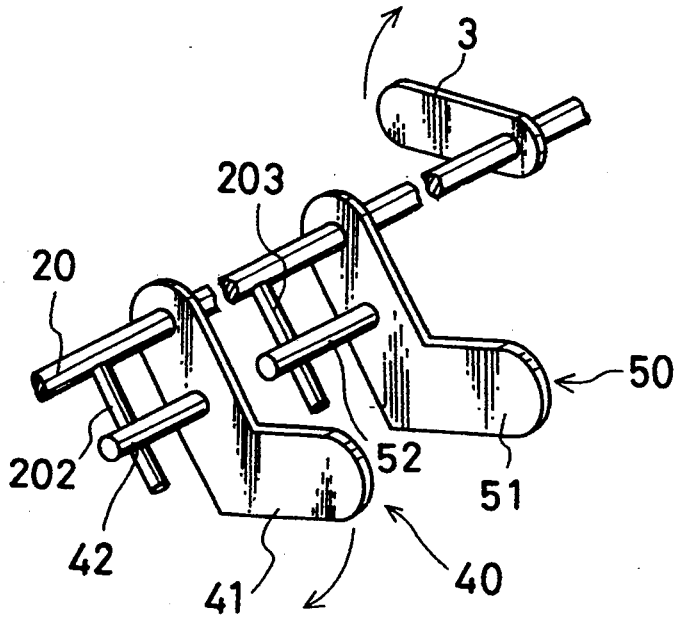
FIG. 11 a perspective view showing a second detecting device for detecting the presence of an item according to the invention.
Figure 12:
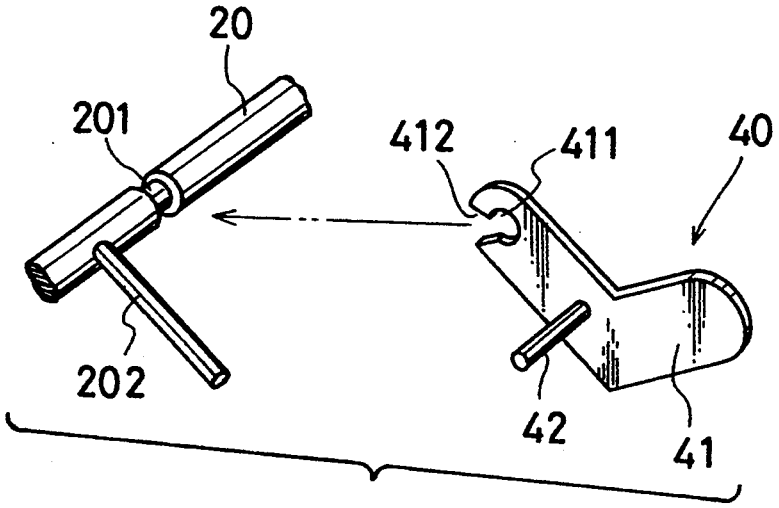
FIG. 12 is a perspective view showing mounting of a contacting member on a shaft in the second detecting device.

There will be described another sheet detecting device 1 as a second embodiment of the invention next with reference to FIGS. 11, 12. It is noted that the photosensor 6 is unillustrated in these figures.

In the second embodiment, a shaft 20 is supported rotatably on the frame of the image forming apparatus. The pivotal member 3 is fixed at a specified position of the shaft 20. On the circumferential surface of the shaft 20 is formed, as shown in FIG. 12, a circular groove 201 in which a contacting plate 41 of the contacting member 40 is fitted loosely.

The contacting member 40 includes the contacting plate 41 and a rod 42. As shown in FIG. 12, a hole 411 is formed at a base portion of the contacting plate 41, such that a portion of the base portion defining the hole 411 (hole defining portion) is fitted loosely in the groove 201. A cut-away portion 412 is also formed at the base portion of the contacting plate 41. The hole defining portion is fitted in the groove 201 by pressing the cut-away portion 412 against a bottom face of the groove 201, and thereby the groove 201 is engaged with the hole defining portion.

The rod 42 is formed on one side face of the contacting plate 41 and extends by a specified length in an axial direction of the shaft 20. On the other hand, a rod 202 is formed at a specified position of the shaft 20 in the vicinity of the groove 201. The sheet detecting device 1 is assembled by pressing the cut-away portion 412 against the bottom face of the groove 201 at such an angle that the rod 202 of the shaft 20 comes into contact with the rod 42 of the contacting member 40 from a counterclockwise direction and fitting the hole defining portion loosely in the groove 201. In this way, the sheet detecting device 1 can be assembled easily since the hole defining portion can be fitted loosely in the groove 201 in a state where the rod 202 is formed on the shaft 20. A contacting member 50, a rod 52 thereof, and a rod 203 of the shaft 20 are formed similarly to the contacting member 40 and the rods 42, 202.

For instance, when the sheets P in the sheet aligning unit 21*a* of the cassette 21 are used up and thereby the contacting plate 41 rotates downward by a specified angle position through a groove 213*a* of a sheet placing plate 211*b* due to the weight thereof, the rod 42 pushes the rod 202 according to the rotation of the contacting plate 41 and the shaft 20 rotates clockwise. According to the rotation of the shaft 20 until the contacting member 40 reaches the suspended position, the pivotal member 3 rotates clockwise to a position between the light emitter and the light detector of the photosensor 6, thereby turning off the photosensor 6. When the sheet aligning unit 21*a* is refilled with sheets P and the contacting member 40 returns to its regular position above the groove 213*a*, the pivotal member 3 rotates back to its regular position due to the weight thereof.

As described above, the second embodiment can obtain effects similar to the first embodiment although it has a simpler construction.

The rods 202, 203 may be fitted to or spirally engaged with the shaft 20. In the above description, the contacting members 40, 50 are positioned where the grooves 201 are formed on the shaft 20. However, the contacting members 40, 50 may be positioned fixedly on the shaft 20 using E-rings.

Figure 13:
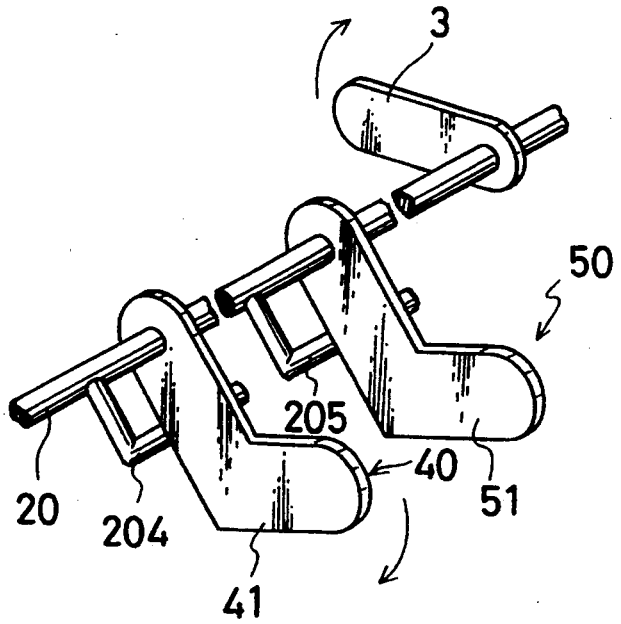
FIG. 13 is a perspective view showing a third detecting device for detecting the presence of an item according to the invention.

There will be described still another sheet detecting device 1 as a third embodiment of the invention next with reference to FIG. 13. It will be appreciated that like reference numerals denote like parts in FIGS. 11, 13 and that the photosensor 6 is unillustrated in FIG. 13.

In the third embodiment, contacting members 40, 50 include only contacting plates 41, 51 and arm members 204, 205 formed on the shaft 20 are bent substantially at right angles at respective intermediate positions so that the contacting plates 41, 51 come to contact with leading portions of the corresponding rods when they rotate clockwise upon the absence of the sheets in the sheet aligning units.

With this arrangement, the third embodiment can act and obtain effects similar to the second embodiment.

Figure 14:
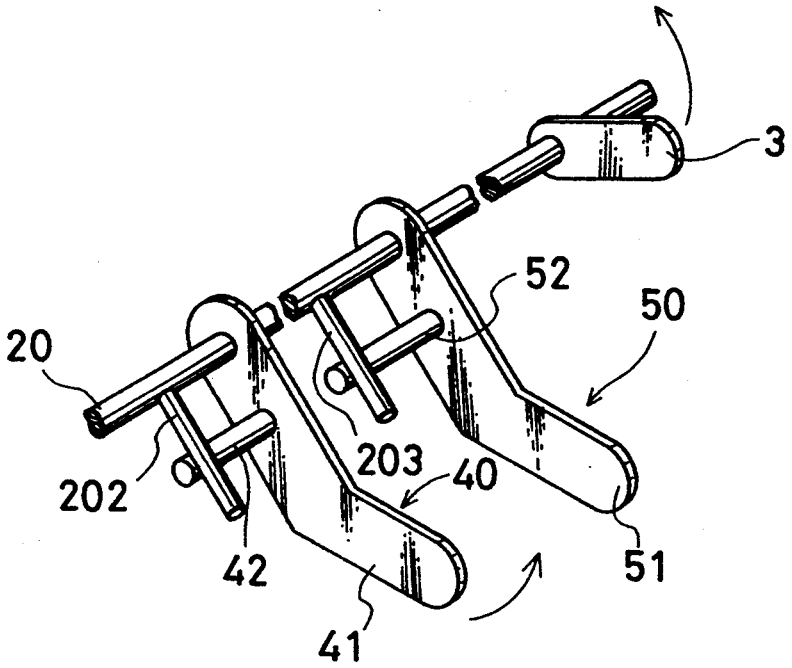
FIG. 14 is a perspective view showing a fourth detecting device for detecting the presence of an item according to the invention.

There will be described a fourth embodiment of the invention next with reference to FIG. 14. The detecting device of the fourth embodiment is applicable to the aforementioned multifeed sensors 36*a*, 36*b*, discharge sensors 39, and the like. It will be appreciated that like reference numerals denote like parts in FIGS. 11, 14 and that the photosensor 6 is unillustrated in FIG. 14.

The fourth embodiment is similar to the second embodiment except that the pivotal member 3 tends to rotate clockwise by the weight thereof. The fourth embodiment is assembled by mounting the contacting members 40, 50 loosely on the shaft 20 at such an angle that the rods 202, 203 formed on the shaft 20 come into contact with the rods 42, 52 of the contacting members 40, 50 from a clockwise direction.

When the contacting members 40, 50 rotate counterclockwise, the rods 202, 203 are pushed respectively by the rods 42, 52 and the shaft 20 rotates counterclockwise. According to the rotation of the shaft 20, the pivotal member 3 rotates counterclockwise by a specified angle to a position between the light emitter and the light detector of the photosensor 6, thereby turning off the photosensor 6.

An operation of the fourth embodiment will be described in the case that this detecting device is used as the multi-feed sensors 36*a*, 36*b*.

The contacting members 40, 50 stay at suspended positions due to the weight thereof until the sheets reach the multifeed sensors 36*a*, 36*b*. When the sheets reach these sensors, the contacting plates 41, 51 of the contacting members 40, 50 are pushed by the corresponding sheets and rotate counterclockwise. Thereby, the rods 202, 203 of the shaft 20 are pushed by the rods 42, 52 of the contacting members 40, 50 and the shaft 20 rotates counterclockwise until the pivotal member 3 comes to the position between the light emitter and the light detector of the photosensor 6. As a result, the photosensor 6 is turned off. After the sheets pass, the contacting plates 41, 51 rotate clockwise due to the weight thereof and the shaft 20 rotates clockwise according to the clockwise rotation of the pivotal member 3 due to the weight thereof. Thereupon, the pivotal member 3 moves away from the photosensor 6, turning the same on again.

However, if two sheets P are transported one over the other, that is, multiple feeding, for example, along the transport path where the contacting member 40 is disposed, movements of the contacting members 40, 50 do not synchronize. More specifically, the contacting member 50 corresponding to the transport path along which the single sheet is transported normally rotates clockwise to the suspended position after the sheet passes, whereas the contacting member 40 is caused to stay at the detecting position since it is kept pushed up by the multiple fed sheets. Accordingly, the rod 202 is kept pushed up by the rod 42 and the pivotal member 3 remains at the position between the light emitter and the light detector of the photosensor 6, keeping the same off. The controller 7 measures an off-period of the photosensor 6 and determines that the multiple feeding has occurred in the case where this off-period is longer than the one when the single sheet is transported normally. Upon determining the occurrence of multiple feeding, the controller 7 stops the feeding operation and causes the display unit 8 to display a warning indicative of the multiple feeding.

As seen from the above, the multiple sensor can detect the occurrence of multiple feeding along either one of the transport paths along which sheets are transported side by side despite its simple construction.

Figure 15:
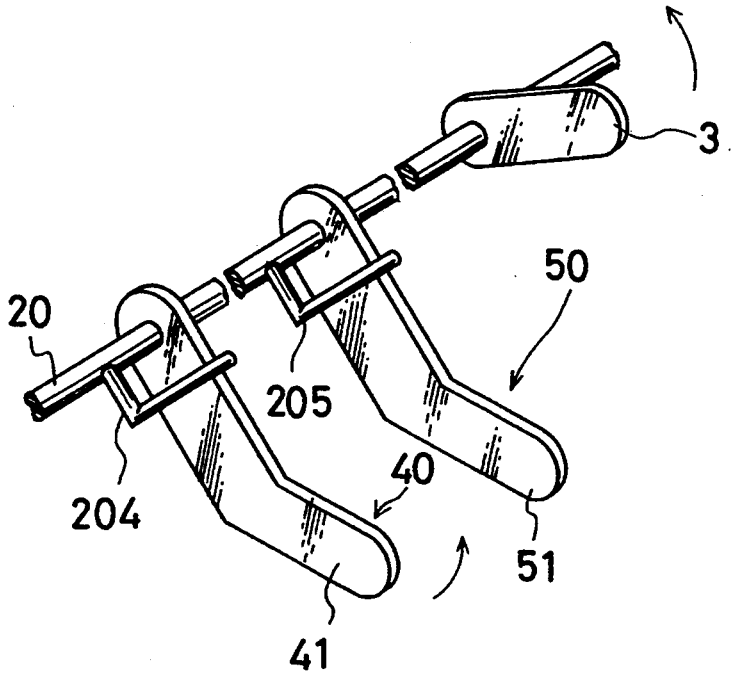
FIG. 15 is a perspective view showing a fifth detecting device for detecting the presence of an item according to the invention.

There will be described a fifth embodiment of the invention next with reference to FIG. 15. It will be appreciated that like reference numerals denote like parts in FIGS. 13 and 15 and that the photosensor 6 is unillustrated in FIG. 15.

The fifth embodiment is similar to the third embodiment in construction except that the pivotal member 3 tends to rotate clockwise by the weight thereof. The fifth embodiment is assembled by mounting the contacting members 40, 50 on the shaft 20 such that the arm members 204, 205 formed on the shaft 20 come to contact with the contacting members 40, 50 from a clockwise direction. Accordingly, the fifth embodiment can operate and provide effects similar to the fourth embodiment.

In the second to fifth embodiments, the rods 202 to 205 formed on the shaft 20 are brought into contact with the contacting members 40, 50 according to the rotation of the pivotal member 3 due to the weight thereof. However, the rods 202 to 205 may be brought into contact with the contacting members 40, 50 by a biasing means. In this case, the angular relationship between the pivotal member 3 and the rods 202 to 205 can be changed, which enables the detecting device to be designed more freely.

Further, the detecting device of the first to third embodiments are not only applicable for detection of the presence of sheets but also applicable for detection of the presence of envelopes, or other items.

It is also possible to use the detecting device according to the invention to an apparatus other than image forming apparatuses.

As described above, according to the invention, when at least one of the contacting plates rotates in one direction, thereby causing a shaft on which the contacting plates are mounted to rotate, a pivotal member rotates in the one direction according to the rotation of the contacting plate and a displacement thereof is detected by a single detecting element. Accordingly, the detecting device has a simplified construction. Further, the time and labor taken for wiring can be reduced.

In the case where the pivotal member rotates according to the rotation of one contacting plate while the other contacting plate does not rotate the other contacting plate will not hinder the pivotal member to rotate in the one direction. Further, even if an increased number of contacting plates are provided, the pivotal member can be easily rotated by only one contacting plate irrespective of the others of the increased number of contacting plates.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A detecting device for detecting the presence of an item comprising:

a shaft rotatably supported on a frame;

a first contacting member attached to the shaft and operable to come into contact with an item;

a second contacting member attached to the shaft and operable to come into contact with an item, the second contacting member being spaced away from the first contacting member in an axial direction of the shaft by a specified distance;

the first and second contacting members being attached to the shaft rotatably independently from each other and each having a tendency of rotating in a specified direction by the weight thereof in respective free states thereof;

a single pivotal member;

detector means for detecting whether the single pivotal member is at a specified detecting position, said detector means being comprised of a single sensor for detecting the single pivotal member; and transmission means operatively associated with the single pivotal member for transmitting a rotation of either the first or second contacting member to the single pivotal member to rotate the single pivotal member to the specified detecting position.

2. A detecting device as defined in claim 1 wherein the shaft includes:

a first support portion for supporting the first contacting member;

a second support portion for supporting the second contacting member;

a shaft member fixedly attached with the pivotal member and being rotatable independently of the first and second contacting members;

the transmission means includes:

a first radial rod fixedly attached to the shaft member and extending outward in a radial direction of the shaft member;

a second radial rod fixedly attached to the shaft member and extending outward in a radial direction of the shaft member;

a first axial rod fixedly attached to the first contacting member and extending in an axial direction of the shaft member and being engageable with the first radial rod;

a second axial rod fixedly attached to the second contacting member and extending in an axial direction of the shaft member and being engageable with the second radial rod;

whereby when either the first or second contacting member rotates beyond a specified rotational angle in the specified direction, either the first or second axial rod engages with the first or second radial rod to transmit the specified direction rotation of the contacting member to the pivotal member.

3. A detecting device as defined in claim 1 wherein the shaft includes:

a first support portion for supporting the first contacting member;

a second support portion for supporting the second contacting member;

a shaft member fixedly attached with the pivotal member and being rotatable independently of the first and second contacting members;

the transmission means includes:

a first arm member fixedly attached to the shaft member and engageable with the first contacting member;

a second arm member fixedly attached to the shaft member and engageable with the second contacting member; and whereby when either the first or second contacting member rotates beyond a specified rotational angle in the specified direction, either the first or second contacting member engages with the first or second arm member to transmit the specified direction rotation of the contacting member to the pivotal member.

4. A detecting device as defined in claim 1 wherein the sensor includes a photosensor having a light emitter and a light receiver sandwiching the single pivotal member.

5. A detecting device for detecting the presence of an item comprising:

a shaft rotatably supported on a frame;

a first contacting member attached to the shaft and operable to come into contact with an item;

a second contacting member attached to the shaft and operable to come into contact with an item, the second contacting member being spaced away from the first contacting member in an axial direction of the shaft by a specified distance;

the first and second contacting members being attached to the shaft rotatably independently from each other and each having a tendency of rotating in a specified direction by the weight thereof in respective free states thereof;

the shaft including:

a first cylinder fixedly attached with the first contacting member;

a second hollow cylinder concentrically provided around the first cylinder and fixedly attached with the second contacting member;

a pivotal member;

detector means for detecting whether the pivotal member is at a specified detecting position; and transmission means for transmitting a rotation of either the first or second contacting member to the pivotal member to rotate the pivotal member to the specified detecting position, the transmission means including:

a first pin provided on one end surface of the first cylinder and extending in an axial direction of the first cylinder;

a second pin provided on one end surface of the second hollow cylinder and extending in the axial direction of the second hollow cylinder; and slit means provided in the pivotal member, the slit means having a first arcuate slit formed along a rotational locus of the first pin and engageable with the first pin, a second arcuate slit formed along a rotational locus of the second pin and engageable with the second pin;

whereby when either the first or second contacting member rotates beyond a specified rotational angle in the specified direction, either the first or second pin transmits the specified direction rotation of the contacting member to the pivotal member.

6. A detecting device for detecting the presence of an item comprising:

a shaft rotatably supported on a frame;

a first contacting member attached to the shaft and operable to come into contact with an item;

a second contacting member attached to the shaft and operable to come into contact with an item, the second contacting member being spaced away from the first contacting member in an axial direction of the shaft by a specified distance;

the first and second contacting members being attached to the shaft rotatably independently from each other and each being stayed at a specified position by the weight thereof in free states thereof and being movable in a specified direction by the item;

a single pivotal member;

detector means for detecting whether the single pivotal member is at a specified detecting position, said detector means being comprised of a single sensor for detecting the single pivotal member; and transmission means operatively associated with the single pivotal member for transmitting a rotation of either the first or second contacting member to the single pivotal member to rotate the single pivotal member to the specified detecting position.

7. A detecting device as defined in claim 6 wherein the shaft includes:

a first support portion for supporting the first contacting member;

a second support portion for supporting the second contacting member;

a shaft member fixedly attached with the pivotal member and being rotatable independently of the first and second contacting members;

the transmission means includes:

a first radial rod fixedly attached to the shaft member and extending outward in a radial direction of the shaft member;

a second radial rod fixedly attached to the shaft member and extending outward in a radial direction of the shaft member;

a first axial rod fixedly attached to the first contacting member and extending in an axial direction of the shaft member and being engageable with the first radial rod;

a second axial rod fixedly attached to the second contacting member and extending in an axial direction of the shaft member and being engageable with the second radial rod;

whereby when either the first or second contacting member rotates beyond a specified rotational angle in the specified direction, either the first or second axial rod engages with the first or second radial rod to transmit the specified direction rotation of the contacting member to the pivotal member.

8. A detecting device as defined in claim 6 wherein the shaft includes:

a first support portion for supporting the first contacting member;

a second support portion for supporting the second contacting member;

a shaft member fixedly attached with the pivotal member and being rotatable independently of the first and second contacting members;

the transmission means includes:

a first arm member fixedly attached to the shaft member and engageable with the first contacting member;

a second arm member fixedly attached to the shaft member and engageable with the second contacting member; and whereby when either the first or second contacting member rotates beyond a specified rotational angle in the specified direction, either the first or second contacting member engages with the first or second arm member to transmit the specified direction rotation of the contacting member to the pivotal member.

9. A detecting device as defined in claim 6 wherein the sensor includes a photosensor having a light emitter and a light receiver sandwiching the single pivotal member.

10. A detecting device for detecting the presence of an item comprising:

a shaft rotatably supported on a frame;

a first contacting member attached to the shaft and operable to come into contact with an item;

a second contacting member attached to the shaft and operable to come into contact with an item, the second contacting member being spaced away from the first contacting member in an axial direction of the shaft by a specified distance;

the first and second contacting members being attached to the shaft rotatably independently from each other and each being stayed at a specified position by the weight thereof in free states thereof and being movable in a Specified direction by the item;

the shaft including:

a first cylinder fixedly attached with the first contacting member;

a second hollow cylinder concentrically provided around the first cylinder and fixedly attached with the second contacting member; and a pivotal member;

detector means for detecting whether the pivotal member is at a specified detecting position; and transmission means for transmitting a rotation of either the first or second contacting member to the pivotal member to rotate the pivotal member to the specified detecting position, the transmission means including:

a first pin provided on one end surface of the first cylinder and extending in an axial direction of the first cylinder;

a second pin provided on one end surface of the second hollow cylinder and extending in the axial direction of the second hollow cylinder; and slit means provided in the pivotal member, the slit means having a first arcuate slit formed along a rotational locus of the first pin and engageable with the first pin, a second arcuate slit formed along a rotational locus of the second pin and engageable with the second pin;

whereby when either the first or second contacting member rotates beyond a specified rotational angle in the specified direction, either the first or second pin transmits the specified direction rotation of the contacting member to the pivotal member.

* * * * *